United States Patent [19]

Ishida et al.

[11] Patent Number: 4,512,655

[45] Date of Patent: Apr. 23, 1985

[54] IMAGE REPRODUCING APPARATUS

[75] Inventors: Masato Ishida; Hiroaki Takeda, both of Kawasaki, Japan

[73] Assignee: Canon Kabushiki Kaisha, Tokyo, Japan

[21] Appl. No.: 603,901

[22] Filed: Apr. 25, 1984

Related U.S. Application Data

[63] Continuation of Ser. No. 434,250, Oct. 14, 1982, abandoned.

[30] Foreign Application Priority Data

Oct. 19, 1981 [JP] Japan ..... 56-16665

[51] Int. Cl.[3] ..... G03G 15/00

[52] U.S. Cl. ..... 355/55; 355/14 C

[58] Field of Search ..... 355/55, 56, 14 C, 14 R, 355/3 R

[56] References Cited

U.S. PATENT DOCUMENTS

| | | | |
|---|---|---|---|
| 4,011,012 | 3/1977 | Kawai | 355/55 |
| 4,316,668 | 2/1982 | Miller | 355/55 |
| 4,360,264 | 11/1982 | Baker et al. | 355/55 X |
| 4,368,976 | 1/1983 | Shogren | 355/55 |

*Primary Examiner*—A. C. Prescott

*Attorney, Agent, or Firm*—Fitzpatrick, Cella, Harper & Scinto

[57] ABSTRACT

When the magnification is changed one or more times during the lens-moving period after a first magnification has been entered the last-entered magnification is made valid to prevent reproduction of an unwanted copy and to allow immediate reproduction of a desired copy. In an enlargement copying operation, the original is scanned for a length corresponding to a transfer paper sheet of a large size; in other copying operations, the original is scanned for a length corresponding to the size of the paper sheet. Over-heating of the original base is thus prevented during reproduction of copies of any size.

10 Claims, 11 Drawing Figures

IMAGE REPRODUCING APPARATUS

This is a continuation of application Ser. No. 434,250 filed Oct. 14, 1982, now abandoned.

BACKGROUND OF THE INVENTION

1. Field of the Invention

The present invention relates to a variable magnification image reproducing apparatus.

2. Description of the Prior Art

In a conventional variable magnification (power) copying machine, a desired copying magnification is selected or changed by the operator. Due to mechanical reasons, selection or change of magnification is prohibited during an interval in which a member for scanning an original image is not its home position. This is especially so where, when the scanning member is not in its home position prior to the initial scanning operation, this state is detected and the member is thereafter set in the home position. In such a case, selection or change of magnification is allowed after the scanning member is set in the home position. Therefore, a considerable period of time is required to complete selection or change of magnification. This results in an inefficient operation.

Selection or change of magnification is also prohibited after a copy start command is generated. More specifically, the operator first selects a magnification prior to a copying operation and then command, thereby starting the copying operation. Once the copy button is depressed to start the copying operation, correction or change of the selected magnification can only be performed after stopping the copying operation. This frequently results in production of an unwanted copy.

In a conventional variable magnification copying machine, the magnification can be varied by varying the scanning speed and stroke of a member for scanning an original in accordance with the magnification and the size of a transfer sheet. Furthermore, a lamp which generates heat such as a halogen lamp is used to illuminate the original to form an image thereof. Therefore, if the magnification is great and the size of the transfer sheet is small, the scanning speed is slow and the scanning stroke is short. For this reason, heat generated by the lamp may locally overheat the original base, causing a problem.

When a magnification is changed with the rotational frequency of a photosensitive drum remaining constant, the speed of the scanning member becomes slow. In the case of a copying machine of the original platen moving type wherein the copying speed is relatively slow from the beginning, the speed of the scanning member becomes still slower. In a conventional copying machine of the type wherein air is drawn from the top of the housing to exhaust air heated by the lamp, the cooling function is degraded to worsen the above problem.

SUMMARY OF THE INVENTION

It is an object of the present invention to provide a variable magnification image reproducing apparatus which eliminates the drawbacks of the conventional apparatuses as described above.

It is another object of the present invention to provide a variable magnification image reproducing apparatus which allows easy selection or change of magnification.

It is still another object of the present invention to provide a variable magnification image reproducing apparatus which allows immediate variable magnification reproduction of an original image.

It is still another object of the present invention to provide a variable magnification image reproducing apparatus with an improved enlarging function.

It is still another object of the present invention to provide a variable magnification image reproducing apparatus which allows immediate selection of magnification and start of variable magnification reproduction.

It is still another object of the present invention to provide an improvement in a variable magnification image reproducing apparatus of the original platen moving type.

It is still another object of the present invention to provide a variable magnification image reproducing apparatus which minimizes erroneous operation and reproduction of unwanted copies.

The above and other objects of the present invention will become apparent from the following description taken in conjunction with the accompanying drawings.

BRIEF DESCRIPTION OF THE DRAWINGS

FIGS. 6-1 to 6-4 are flowcharts showing a control program according to the present invention.

DETAILED DESCRIPTION OF THE PREFERRED EMBODIMENTS

Figure 1:
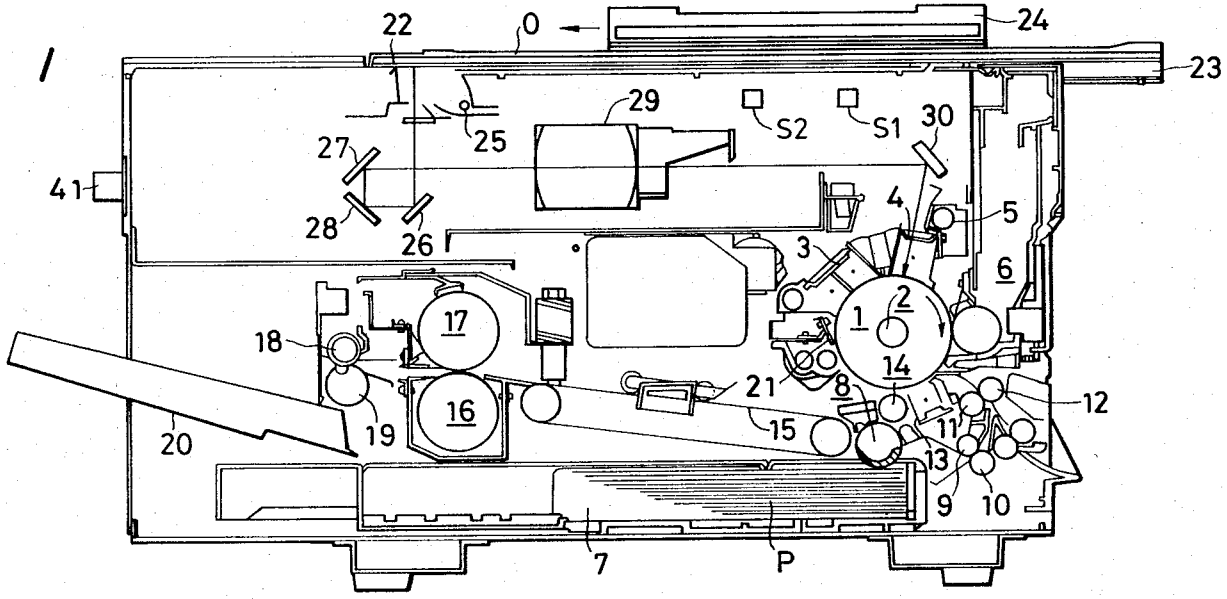
FIG. 1 is a sectional view of an image reproducing apparatus according to an embodiment of the present invention.

FIG. 1 shows an image reproducing apparatus of the original platen moving type according to an embodiment of the present invention. This apparatus is capable of enlargement, equal magnification and reduction reproduction. The surface of a photosensitive drum 1 comprises a photosensitive body of a photoconductive material which is seamless along the circumferential direction of the drum 1. The photosensitive drum 1 is rotatably supported on a shaft 2 and is driven by a main motor (not shown) at a constant speed in the direction indicated by the arrow. The rotational speed of the photosensitive drum 1 is held constant irrespective of the magnification. The photosensitive surface of the photosensitive drum 1 is uniformly charged by a D.C. corona discharger 3. Subsequently, the photosensitive drum 1 is slit-exposed by an optical system to be described later in the pattern of the image on an original placed on an original base 23, and is simultaneously subjected to a corona discharge of a D.C. corona discharger 4 of the opposite polarity to that of the D.C. discharger 3. The D.C. discharger 4 has a slit to allow passage of the light carrying infromation of the image on the original. The photosensitive drum 1 is then uniformly illuminated by a lamp 5 to form a high contrast electrostatic latent image of the original. The image is developed when toner is supplied to the photosensitive drum 1 by a developing unit 6.

A transfer paper sheet P held in cassette 7 is fed by a pickup roller 8 and is fed to register rollers 11 and 12 by convey rollers 9 and 10. When the original base 23 is moved and a registration sensor S2 is operated, the register rollers 11 and 12 are rendered operative by a command from a microcomputer (not shown) to feed the transfer paper sheet P toward the photosensitive drum 1 at a proper timing.

While the transfer paper sheet P passes the space between a transfer charger 13 and the photosensitive drum 1, the toner image formed on the photosensitive drum 1 is transferred onto the transfer paper sheet P.

After completion of the transfer operation, the transfer paper sheet P is separated from the photosensitive drum 1 by a separation roller 14 and is guided to a conveyor belt 15. Then the transfer paper sheet P reaches a pair of fixing rollers 16 and 17 which press and heat it, and is thereafter exhausted onto a tray 20 by exhaust rollers 18 and 19.

After the transfer operation, the photosensitive drum 1 continues to rotate. The surface of the photosensitive drum 1 is cleaned with a cleaning device comprising an elastic blade 21, and is ready for the next copying cycle.

A transparent glass plate 22 is fixed to the original base 23. When an original O is placed on the glass plate 22, the surface of the original O to be reproduced is opposed to an image-forming optical system. The original O is held by an original holder 24. Light emitted by an original exposure lamp 25 is reflected by the surface of the original O, is guided through a first mirror 26, a second mirror 28 and a third mirror 27, and is focused on the photosensitive drum 1 through a lens 29 and a mirror 30.

An image of magnification m ($m+b/a$) is formed on the photosensitive drum 1 if a relation $1/a+1/b=1/f$ is satisfied where a is the length of the optical path between the major surface of an imaging lens 29 and the original O, b is the length of the optical path between the major surface of the imaging lens 29 and the exposure position of the photosensitive drum 1, and f is the focal length of the imaging lens 29. Using m and f, a and b may be expressed as follows:

$$a=(m+1)f/m,\ b=(m+1)f$$

It follows from this that a and b must be changed to change the magnification.

In this embodiment, a and b are changed by changing the positions of the imaging lens 29, the second mirror 28 and the third mirror 27 to thereby change the magnification.

When the photosensitive drum 1 is exposed, the original base 23 is moved in the direction indicated by the arrow in synchronism with the rotation of the photosensitive drum 1. The speed of movement of the original base 23 can be varied by selectively driving a plurality of clutches (not shown) for transmitting driving force to the original base 23, and is a value obtained by multiplying the peripheral speed of the photosensitive drum 1 by the magnification. After completing its movement, the original base 23 is returned to its home position. At this time, a home sensor S1 to be described later is operated by the original base 23.

A control counter 41 (a total counter to count the total number of copies produced) can be detached from the main body of the apparatus by pulling it in the direction indicated by the arrow. If the control counter 41 is not mounted, the copying operation may not be initiated.

Figure 2:
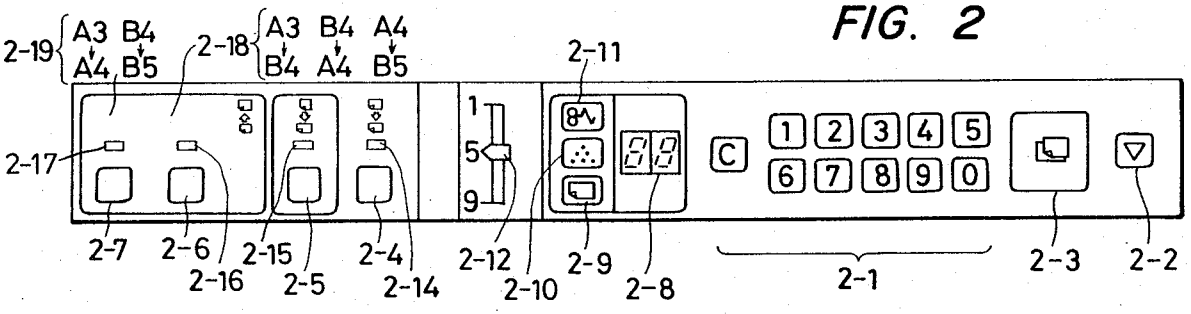
FIG. 2 is a plan view of a control panel of the apparatus shown in FIG. 1.

FIG. 2 is a plan view of a control panel arranged on the top surface of the apparatus shown in FIG. 1. A numeral input section 2-1 has a combination of ten keys for setting a desired number of copy sheets to be produced, and a clear key for cancelling the numeral set thereby. A copy key 2-3 is for instructing copy operation start. A stop key 2-2 is for stopping the current copying operation. Copying magnification selection keys 2-4 to 2-7 are for selecting a desired magnification. Indicators 2-14 to 2-17 indicate the selected copying magnification, while indicators 2-18 and 2-19 corresponding to the keys 2-6 and 2-7 indicate the size of the cassette 7.

A copy sheets display 2-8 displays the number of copies to be produced, which is entered through the numeral input section 2-1. Indicators 2-9 to 2-11 comprise light-emitting diodes; the indicator 2-9 indicates jamming when the transfer paper sheet P is jammed in the apparatus, the indicator 2-10 indicates dificiency of toner, and the indicator 2-11 indicates absence of the transfer paper sheets P from the cassette 7. A density setting lever 2-12 sets the density of a copy to be produced.

Figure 3:
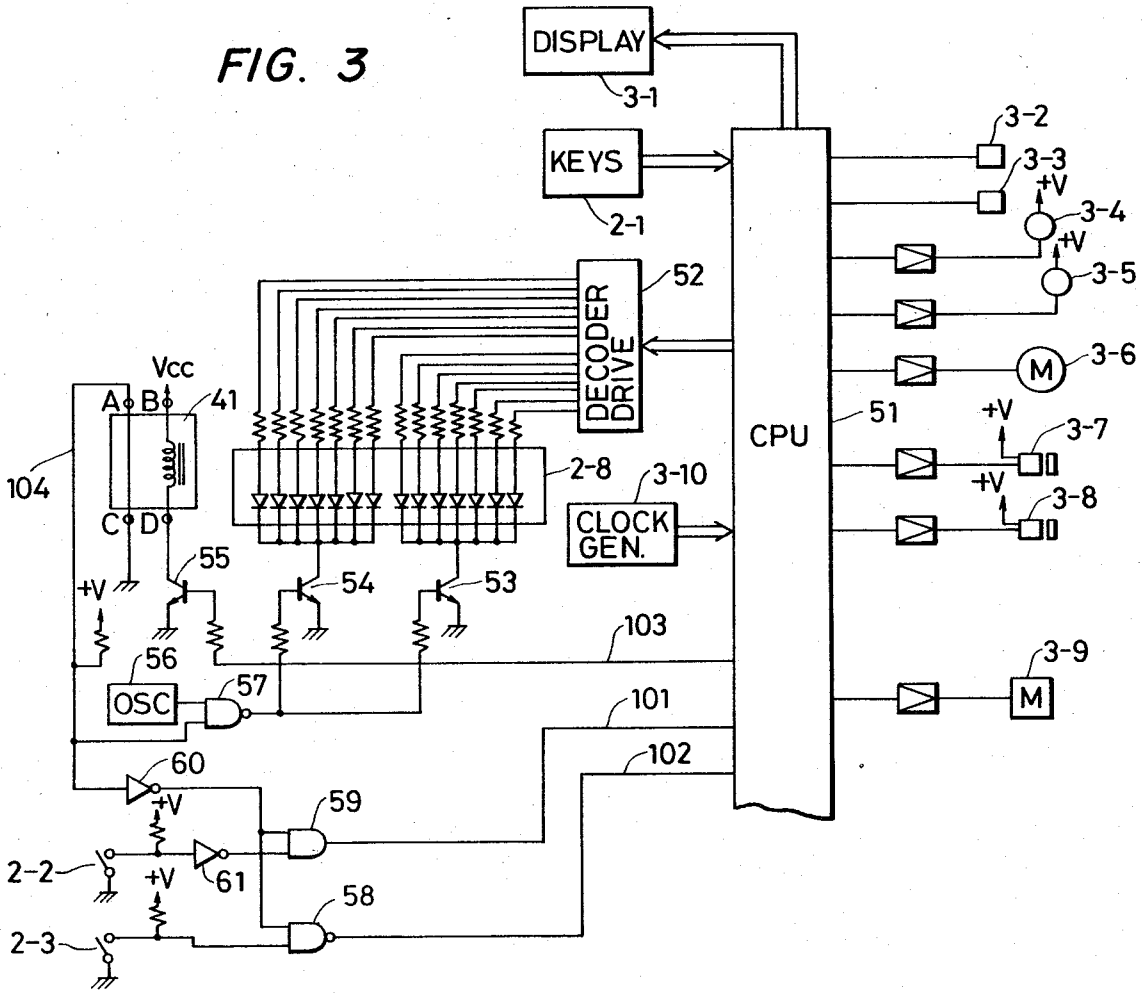
FIG. 3 is a block diagram of control circuitry of the embodiment shown in FIG. 1.

FIG. 3 is a circuit diagram of the control circuitry according to the embodiment of the present invention. A control CPU 51 for controlling the operation of the apparatus comprises a known microcomputer such as a μCOM43. A decoder driver 52 drives the copy sheets display 2-8. As described above, the control counter 41 is detachable from the apparatus main body and has contacts A, B, C and D. An oscillator 56 oscillates at a low frequency of about 1 kHz to flash the display 2-8. The output end of the oscillator 56 is connected to one input end of a NAND gate 57, whose other input end is connected to one end of an AND gate 59 and to one end of a NAND gate 58 through an inverter 60. The other input end of the AND gate 59 is connected to the stop key 2-2 through an inverter 61. The other input end of the NAND gate 58 is connected to the copy key 2-3.

The mode of operation of the circuitry as described above will now be described. The control CPU 51 receives signals from the ten keys of the numeral input section 2-1, reads the numeral set thereby, and transfers the read numeral to the decoder driver 52 for display. The control CPU 51 receives a copy start signal 101 from the copy start key 2-2 through the inverter 61 and the AND gate 59, and drives the respective processing means to start the copying operation. In response to an LED drive signal from the decoder driver, the copy sheets display 2-8 drives seven-segment LEDs to display the selected number of copy sheets to be reproduced.

A description will first be made of the case wherein the control counter 41 is mounted. In this case, the contacts A, B, C and D of the control counter 41 are connected. A control counter signal 104 of logic level "0" is supplied to the other input terminal of the NAND gate 57 which thus produces a signal of logic level "1". Then, the copy sheets display 2-8 is continuously driven since transistors 53 and 54 are ON. The control counter signal 104 of logic signal "0" is also supplied to the AND gate 59 and the NAND gate 58 through the inverter 60. When the copy start key 2-2 is depressed, a signal of logic level "1" is supplied to the AND gate 59 through the inverter 61. Then, the AND gate 59 supplies a copy start signal 101 of logic level "1" to the control CPU 51 to start the copying operation. When the stop key 2-3 is depressed during the copying operation, a copy stop signal 102 of logic level "1" is supplied to the control CPU 51 through the NAND gate 58 to stop the copying operation.

In this manner, when the control counter 41 is mounted, the copy sheets display 2-8 is continuously driven to allow the copying operation to start. A copy sheets signal 103 is also supplied to the control counter 41 from the control CPU 51 through a transistor 55 to count the number of copies produced.

A description will now be made of the case wherein the control counter 41 is not mounted. In this case, the contacts A, B, C and D are open, and the control counter signal 104 is at logic level "1". Therefore, the output signal from the NAND gate 57 is alternately set at logic levels "0" and "1". The transistors 53 and 54 are repeatedly turned ON and OFF to flash the copy sheets display 2-8. A signal of logic level "0" from the inverter 60 is supplied to the AND gate 59 and the NAND gate 58 whose output signals are set at logic level "0" and "1", respectively. Even if the copy start key 2-2 is depressed in this state, a copy start signal of logic level "1" may not be supplied to the control CPU 51.

If the control counter 41 is detached from the apparatus main body during the copying operation, a signal of logic level "0" is supplied to the one input end of the NAND gate 58, and a copy stop signal of logic level "1" is supplied to the control CPU 51. The image reproducing apparatus then stops the copying operation according to the sequence which is the same as the case wherein the stop key 2-3 is depressed.

In this manner, when the control counter 41 is not mounted, the copy sheets display 2-8 flashes to indicate this state and the copying operation is prohibited. A similar state may be established when the cassette 7 is not mounted.

A magnification display 3-1 on the control panel displays the selected magnification. A home sensor 3-2 corresponds to S1, while a registration sensor 3-3 corresponds to S2. A forward clutch 3-4 is for forward movement of the original base, while a backward clutch 3-5 is for backward movement of the original base. The circuitry further includes a main motor 3-6, a clutch 3-7 for actuating the pickup roller 8, a clutch 3-8 for actuating the register rollers 11 and 12, a lens drive motor 3-9 for moving the imaging lens 29 to a position corresponding to the selected magnification, and a clock pulse generator 3-10 of known configuration, which generates clock pulses for the magnification selection keys 2-4 to 2-7 on the control panel, for a switch of known configuration for generating a size signal upon mounting the cassette 7, and for sequence control.

Figure 4:
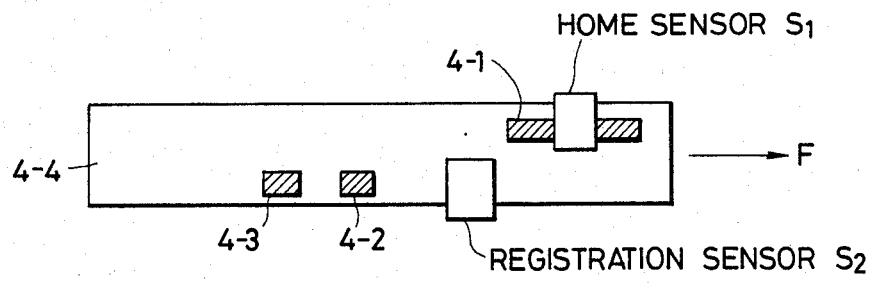
FIG. 4 is a view showing the configuration of a sensor for an original base.

FIG. 4 shows the home sensor S1, the registration sensor S2 and the original base. Portions of a shield plate 4-4 which are indicated by hatched lines are cut away to define holes 4-2 and 4-3.

Figure 5:
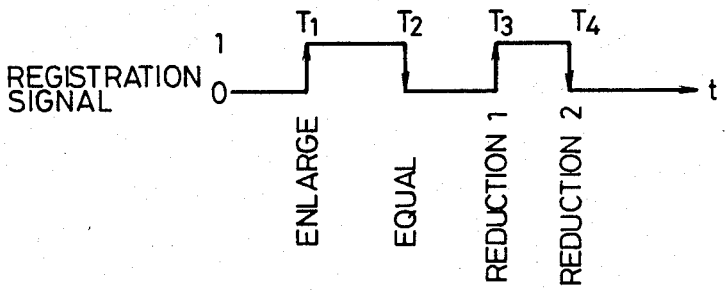
FIG. 5 shows the output of the sensor shown in FIG. 4.

The registration sensor S2 and the home sensor S1 are reflection-type photosensors. When light is guided through the hole 4-2 or 4-3 indicated by hatched lines, the registration sensor S2 or the home sensor S1 produces a signal of logic level "1", and produces a signal of logic level "0" otherwise. If the signal of logic level "1" is supplied from the home sensor S1, the control CPU 51 judges that the original base 23 is in its home position. When the original base 23 moves in the direction indicated by arrow F (forward), the state of the output signal from the registration sensor S2 becomes as shown in FIG. 5 in correspondence with the holes 4-2 and 4-3.

The clutch 3-8 is actuated at times T1, T2, T3 and T4, respectively, in enlargement copy, equal magnification copy, reduction copy mode 1, and reduction copy mode 2. Upon this operation, the leading end of the image on the photosensitive drum 1 is aligned with the leading end of the transfer paper sheet P. Thus, more magnifications may be achieved with a smaller number of registration sensors.

Figures 1, 6:
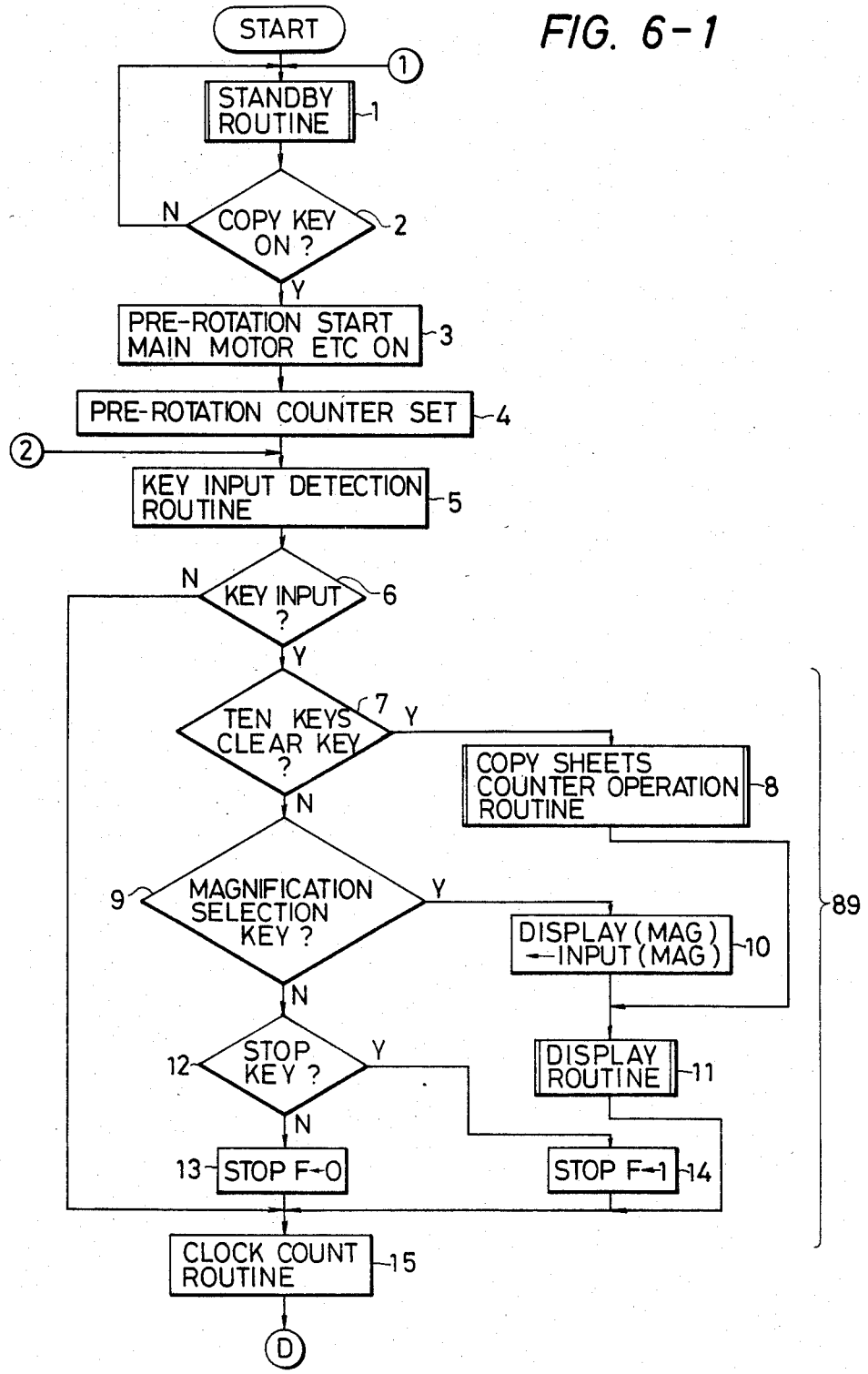
Figures 2, 6:
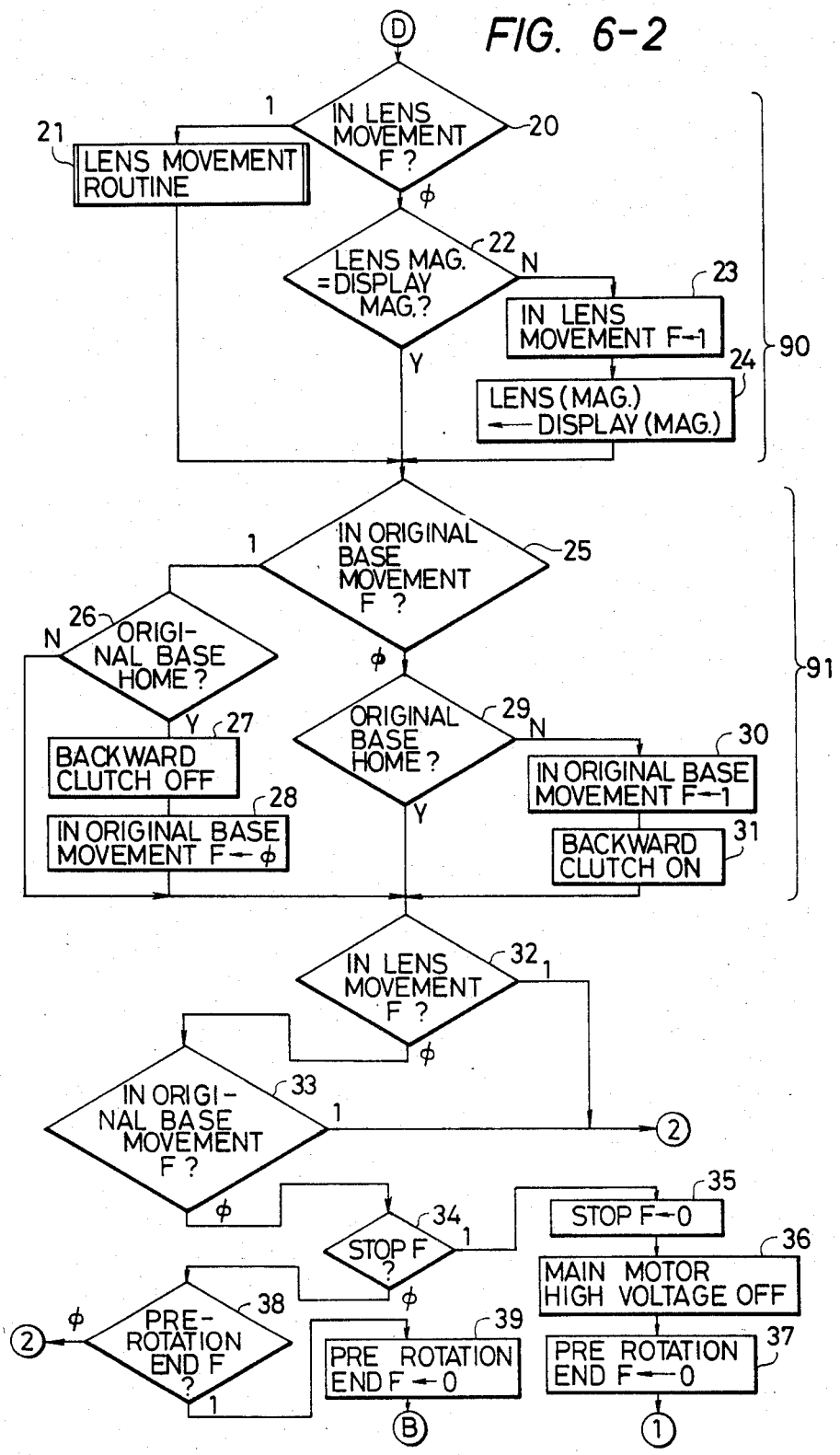
Figures 3A, 6:
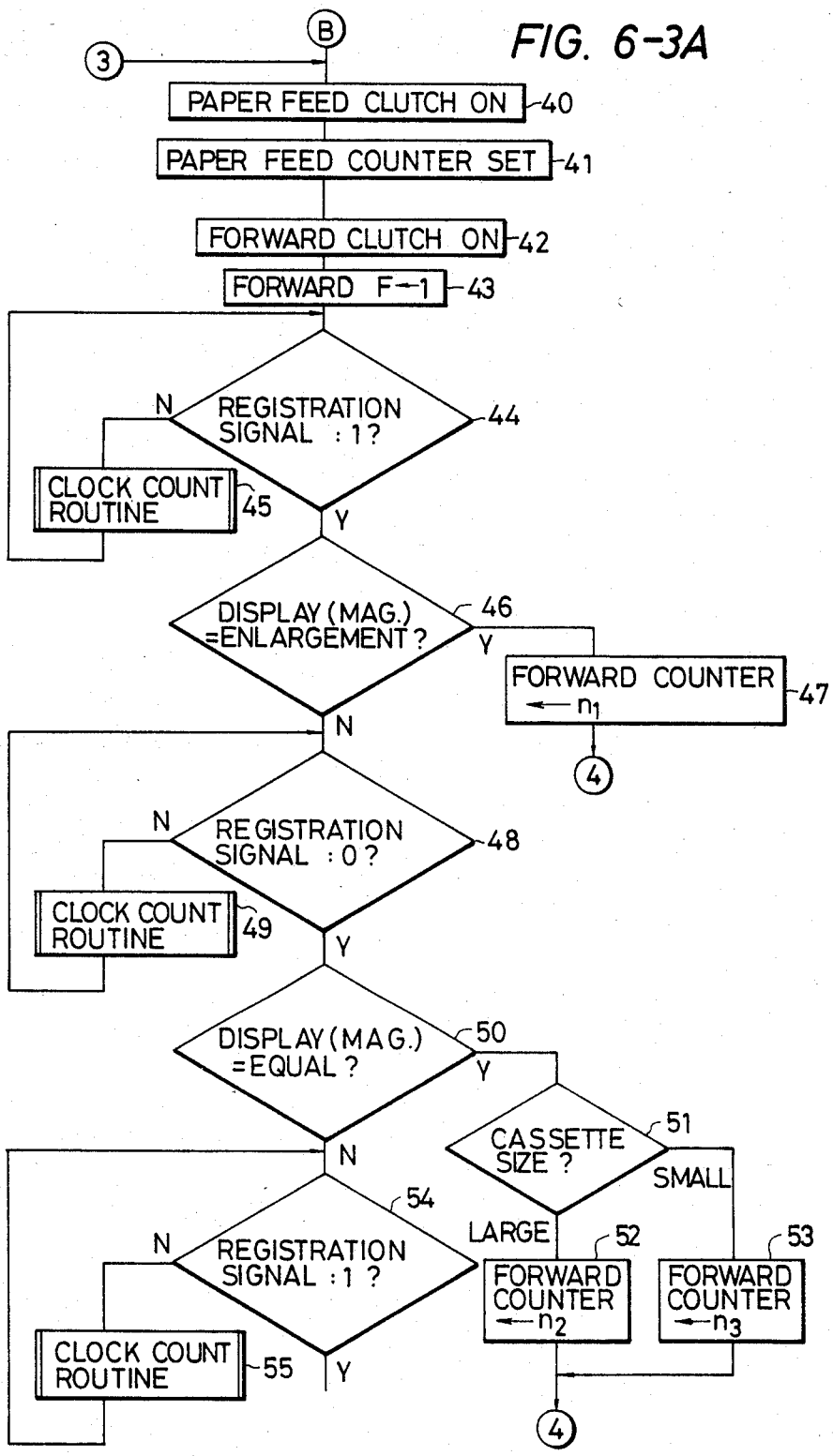
Figures 3B, 6:
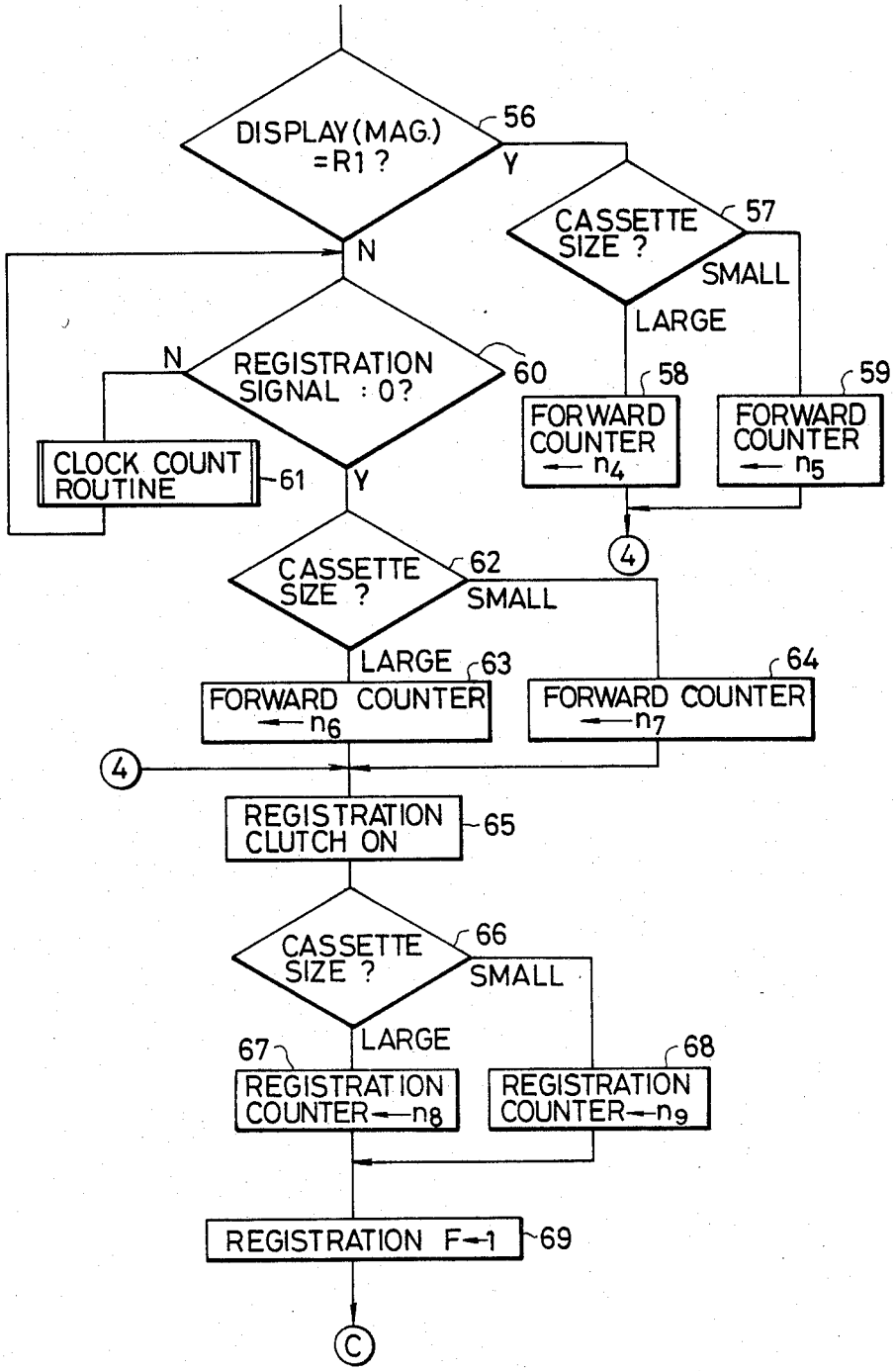
Figures 4, 6:
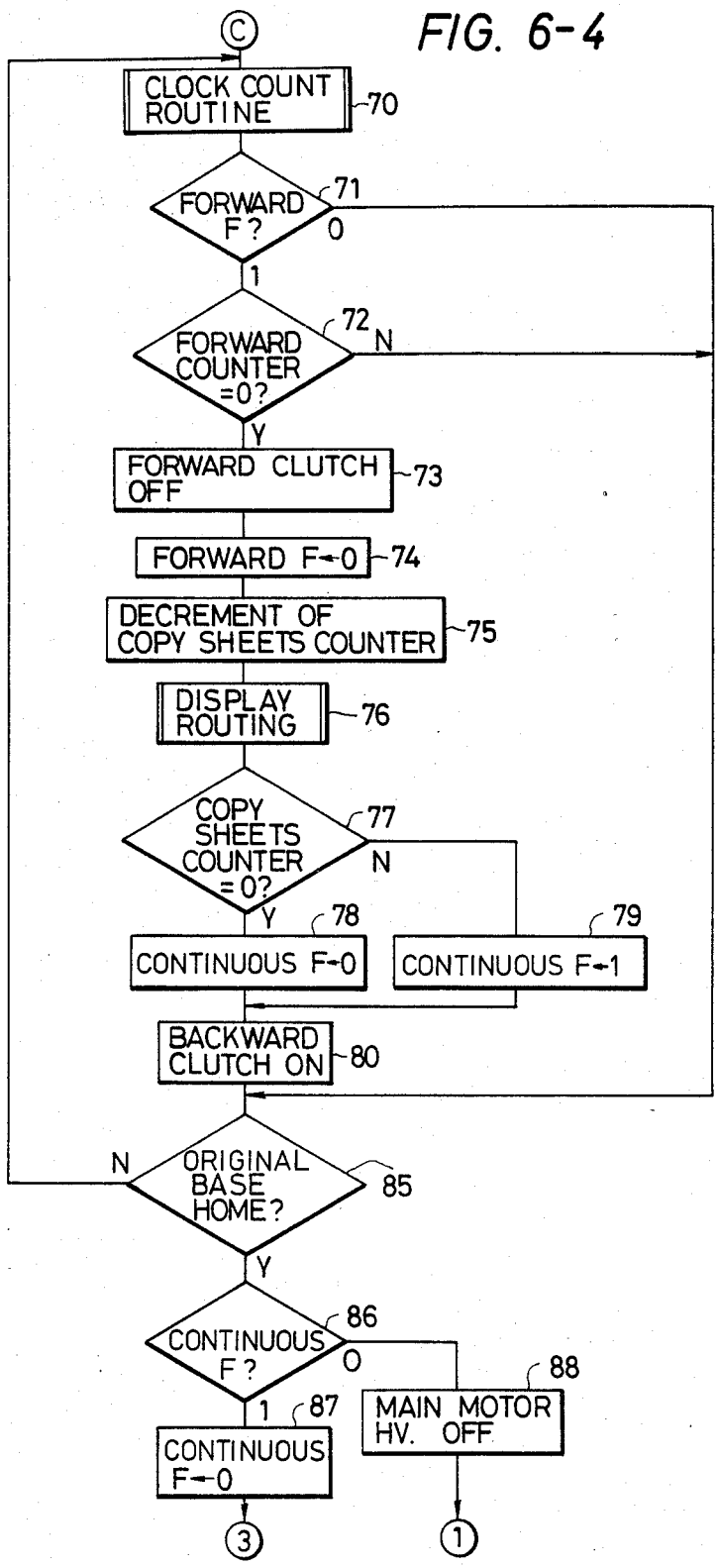

FIGS. 6-1 to 6-4 show a flowchart of a control program stored in a ROM of the control CPU 51.

A RAM in the control CPU 51 stores flags "stop F", "pre-rotation end F", "in lens movement F", "in original base movement F", "forward F", and "continuous F". A copy sheets counter, a pre-rotation counter, a paper feed counter, a registration counter, and a forward counter respectively count the number of copies, time and so on and respectively correspond to predetermined memory areas of the RAM. "Display (mag.)" indicates a magnification selected via the copying magnification selection keys 2-4 to 2-7. "Lens (mag.)" indicates the position of the lens corresponding to a copying magnification.

A standby routine (step 1 and so on ) is a routine for controlling the operation of the image reproducing apparatus until a copy start signal is supplied through the copy start key 2-3. In the standby routine, various key inputs are discriminated and displayed. A key input detection routine (step 5) is a routine for discriminating various key inputs and is included in the standby routine as well. A copy sheets counter routine (step 8) is a routine for controlling the count of the copy sheets counter in the CPU so as to set the number of copies to be produced in accordance with the ten key input detected in the key input detection routine and the input data obtained through the clear key.

A display routine (step 11) is a routine for displaying the magnification and the copy sheets number and is included in the standby routine.

A lens movement routine (step 21) is a routine for moving the imaging lens 29 in accordance with the magnification. The imaging lens 29 is moved to a position corresponding to the lens magnification. Upon completion of the movement of the imaging lens 29, the "in lens movement F" is set to "0". The clock count routine (steps 15, 45, 49, 55 and 61) is a routine for counting the clock pulses which are synchronous with the operation of the image reproducing apparatus. Every time a clock pulse is generated, the pre-rotation counter, the paper feed counter, the registration counter and the forward counter are decremented if the counts thereof are not 0. If the count of the pre-rotation counter becomes 0 in this routine, the "pre-rotation end F" is set to 1 to turn on the paper feed clutch and the forward clutch. If the count of the paper feed counter is 0, the clutch 3-7 is turned off. If the count of the registration counter is 0, the clutch 3-8 is turned off. If the count of the forward counter is 0, the forward clutch is turned off. The forward counter determines the stroke of the original base.

The key input detection routine, the display routine, the copy sheets counter routine, the lens movement routine, the clock count routine and the standby routine are respectively executed within short periods of time; they appear to be executed almost simultaneously.

One lens movement routine (step 21) is performed within a short period of time. The movement of the imaging lens 29 is performed by performing the lens movement routine several times.

When the power is supplied, the flow advances from step 1 to step 2. If the copy start key is not depressed, a loop of steps 1, 2, and 1 is repeatedly executed. During this time period, the copy sheets number is input via the ten keys, and a desired magnification is input via the copying magnification selection keys. When the copy start key is depressed, the flow advances from step 2 to step 3 wherein the copy sequence is initiated; the main motor 3-6 and a high-voltage output are turned on to actuate the drum, chargers and so on. In step 4, the pre-rotation counter 4 is set so as to regulate the length of pre-rotation of the photosensitive drum 1. Loops indicated by numerals 89 to 91 in FIGS. 6-1 to 6-4 correspond to the operation of the apparatus prior to supply of a transfer paper sheet. During these loops, the imaging lens 29 is moved, the original base 23 is returned to the home position, and the photosensitive drum 1 is pre-rotated. These operation are performed at the same time. During these loops, various key inputs by the operator may be received. For this reason, the imaging lens may be moved before the original base 23 is returned to the home position or before the photosensitive drum 2 is pre-rotated. Accordingly, the standby time may be decreased to the minimum. Furthermore, since the magnification may be selected before the original base 23 is returned to the home position and the photosensitive drum 1 is pre-rotated, the magnification may be changed within a short period of time.

When the photosensitive drum 1 is pre-rotated, the drum is cleaned by the blade 21 and the lamp 5.

In step 5, a key input is detected. If there is no key input, step 6 is executed. Assuming that there is no key input, then steps 15, 20 and 22 are further executed. In step 22, it is discriminated if the display magnification or the magnification selected by the operator coincides with the corresponding position of the imaging lens. If YES in step 22, the lens need not be moved and the flow advance to steps 25 and 29. If the original base 23 is discriminated to be at the home position in step 29, the original base 23 need not be returned, and the flow advances to steps 32, 33, 34 and 38. Since the "pre-rotation end F" is 0 in step 38, the flow returns to step 5.

In this manner, when there is no key input and therefore neither the lens nor the original base need be moved, the sequence follows steps 5, 15, 20, 22, 25, 29, 32, 33, 34, 38, and 5 to repeat the clock count routine. When pre-rotation of the photosensitive drum 1 for a predetermined time interval is completed, that is, when a predetermined number of clock pulses are counted, the "pre-rotation end F" is set to 1. The above sequence is repeated until this state is achieved.

If NO in step 22, the flow advances to step 23 wherein the "in lens movement F" is set to 1, and then to step 24 wherein the content of the display (mag.) RAM is set in the lens (mag.) RAM. The flow then advances to step 25. The flow then advances to step 32 through several branches. Since the "in lens movement F" is set to 1 this time, the flow returns from step 32 to step 5 and then advances to steps 15 and 20. Since the "in lens movement F" is set to 1 in step 20, the flow advances to step 21 wherein the imaging lens is moved to a position corresponding to the lens (mag.). A loop of steps 91, 32, 5, 15, 20, 21, and 91 is repeated until the movement of the imaging lens 29 is completed.

If NO in step 29, the flow advances to step 30 wherein the "in original base movement F" is set to 1 and to step 31 wherein the backward clutch 3-5 is turned on to return the original base 23 to the home position. In accordance with the state of the "in lens movement F", the flow follows steps 32 and 5 or steps 32, 33 and 5. From step 5, the flow advances to steps 15, 90 and 25. Since the "in original base movement F" is 1 at this time, steps 26, 32 and 5 are performed. This loop changes to steps 26, 27 and 28 when the original base 23 reaches the home position. The backward clutch 3-5 is turned off, and the "in original base movement F" is set to 0.

Therefore, if there is no key input, steps 5, 15, 90 and 91 are performed; if the "in lens movement F" is 0 and if the "in original base movement F" is 0, it is discriminated whether the "pre-rotation end F" is 1. If the "pre-rotation end F" is 1, the flow advances to step 39 wherein the "prerotation end F" is set to 0 and then the flow advances to step 40 for paper feed operation. In this manner, the paper feed operation is initiated only if the imaging lens is at a position corresponding to the selected copying magnification, the original base is in the home position, and pre-rotation of a predetermined length is completed. Steps 3, 4, 90, 91 and 33 may also be included in the standby routine.

A description will now be made of the case wherein there is a key input before the paper feed operation is initiated. If there are key inputs through the ten keys and the clear key, steps 5, 6, 7, 8, 11 and 15 are performed; the copy sheets counter is incremented/decremented in accordance with the key inputs. If the copying magnification keys are operated, steps 5, 6, 7, 9, 10 and 11 are performed to store the input magnification as the display (mag.) and to display it. If the "in lens movement F" is 0 in step 90, steps 20, 22, 23 and 24 are performed to move the imaging lens 29 to a position corresponding to the display (mag.). If the "in lens movement F"is 1 in step 90, steps 20 and 21 are executed. When the magnification is changed before the paper feed operation and when the "in lens movement F" is 0, that is, when the lens movement is not performed, the imaging lens 29 is immediately moved to a position corresponding to the changed magnification. On the other hand, when the "in lens movement F" is 1, that is, when the imaging lens 29 is being moved, the lens is moved after the current lens moving process is completed.

For example, when the enlargement selection key is depressed during a time interval wherein the imaging lens is moved from the reduction position to the equal magnification position, after then lens movement to the equal magnification position (after the "in lens movement F" is 0), steps 20, 22, 23 and 24 are executed to move the imaging lens 29 to the enlargement position. When the enlargement key is depressed and the reduction mode 1 key 2-6 is subsequently depressed during a time interval wherein the imaging lens 29 is being moved to the equal magnification position, the lens (mag.) is not changed since steps 20 and 21 are executed although the display (mag.) is changed to the enlargement and the reduction mode 1. When the movement of the imaging lens 29 to the equal magnification position is completed, steps 20, 22, 23 and 24 are executed. In step 24, the lens (mag.) is set to the reduction mode 1 of the display (mag.) and the imaging lens 29 is now moved to the position of the reduction mode 1. When the enlargement key is depressed and the equal magnification key is subsequently depressed during a time interval wherein the imaging lens 29 is being moved to the equal magnification position, the lens is not moved after it is moved to the equal magnification position.

In this manner, if the copying magnification is changed, the display (mag.) alone is changed to change the display magnification, and the lens (mag.) is changed after completion of the current lens movement. Therefore, even if the magnification is changed a plurality of times during the lens movement, the magnification which is selected last is made effective so that movement of the lens 29 may not be wasted and the lens may be moved to the position corresponding to the magnification selected last by the operator within a short period of time. This applies independently of the kinds and order of the keys operated.

When the copy step key is depressed before the paper feed operation, steps 5, 6, 12 and 14 are executed. The high level of the copy stop signal is detected, and the "stop F" is set to 1. Steps 14, 15, 90, 91, and 32 are executed. If the "in lens movement F" is 1 and the "in original base movement F" is 1, steps 32 and 5 or steps 32, 33 and 5 are executed. When the movement of the lens and the original base is completed in steps 90 and 91, steps 32, 33, 34 and 35 are executed. The "stop F" is set to 0. The main motor and the high-voltage are turned off in step 26 to stop the apparatus. The "pre-rotation end F" is set to 0 in step 37, and the flow returns to step 1 to repeat the standby routine.

When the stop key 2-3 is depressed, the operation of the apparatus is not completely immediately stopped but is stopped after completing the movement of the original base. Therefore, operation may be immediately performed when a next copy start signal is supplied. The above applies to the cases wherein the control counter 41 or the cassette 7 are detached from the apparatus main body.

The magnification may be changed during the movement of the lens of the original base, so that the copying time may be reduced to the minimum. The apparatus moreover can readily respond to correction of erroneous key inputs or to a change in the magnification.

Although the present invention can be applied to an image reproducing apparatus of the type wherein the mirrors and lens are moved, it is also conveniently applied to an image reproducing apparatus of the platen moving type.

The mode of operation after paper feed operation initiation will now be described.

The paper feed clutch is turned on in step 40, and the paper feed counter is set in step 41. The paper feed counter counts down through the clock counter routine 45 or the like, and the paper feed clutch is turned off as described hereinbefore.

The forward clutch 3-4 is turned on in step 42 to move the original base 23 forward so as to start image scanning. In step 43, the "forward F" is set to 1.

In step 44, it is discriminated if the registration signal from the registration sensor S2 is at logic level "1". If YES in step 44, the flow advances to step 46 to check the display (mag.). On the other hand, if NO in step 44, the flow runs through a loop of steps 44, 45 and 44. The timing of the signal of logic level "1" in step 44 is a registration timing for enlargement copying, and the display (mag.) is the enlargement copy magnification. If YES in step 46, the flow goes to step 47 to set $n_1$ in the forward counter or to set the number of forward pulses, which determines the forward stroke. The flow then goes to step 65. If NO in step 46, the flow advances to step 48 wherein it is discriminated whether the registration signal is logic level "0". If NO in step 48, a loop of steps 48, 49 and 48 is performed . When YES is obtained in step 48, the flow advances to step 50.

This timing corresponds to the registration timing for equal magnification copying. In step 50, it is discriminated if the display (mag.) is the equal magnification. If YES in step 50, step 51 is performed to discriminate the size of the cassette. If the size is large, step 52 is performed to set $n_2$ in the forward counter. On the other hand, if the cassette size is small, $n_3$ is set in the forward counter. The flow then goes to step 65. If NO in step 50, the flow goes to step 54, and a loop of steps 54, 55 and 54 is repeated until the registration signal goes to logic level "1".

When the registration signal goes to logic level "1", the flow advances from step 54 to step 56. This timing is the registration timing for the reduction mode 1. In step 65, it is discriminated if the display (mag.) is the reduction mode 1 (R1). If YES in step 56, the flow advances to step 57 wherein the cassette size is discriminated. If the cassette size is discriminated to be large in step 57, $n_4$ in set in the forward counter in step 58 and the flow advances to step 65. On the other hand, if the cassette size is small in step 57, $n_5$ is set in the forward counter in step 59, and the flow advances to step 65. If NO in step 56, the flow advances to step 60, and a loop of steps 60, 61 and 60 is repeated until the registration signal goes to logic level "0". When the registration signal goes to logic level "0", the flow advances to step 62. This timing is the registration timing for reduction mode 2. In step 62, the cassette size is discriminated. If the cassette size is large, $n_6$ is set in the forward counter in step 63 and the flow advances to step 65. If the cassette size is small, $n_7$ is set in the forward counter and the flow advances to step 65.

The clutch 3-8 is turned on in step 65, and the cassette size is discriminated in step 66. If the cassette size is large, $n_8$ is set in the register counter for setting the number of pulses to be supplied to the registration clutch, and the flow advances to step 69. If the cassette size is small, $n_9$ is set in the registration counter and the flow advances to step 69. In step 70 to follow, pulses numbering $n_8$ or $n_9$ are generated and the registration clutch is turned off.

In step 71, it is discriminated whether the "forward F" is 1. Since YES in step 71 in this case, the flow advances to step 72 wherein it is discriminated whether the count of the forward counter is 0. If NO in step 72, the flow advances to step 85 to check the signal from the home sensor S1. However, since the original base 23 is not in the home position in this case, steps 85 and 70 are repeated. A loop of steps 70, 71, 72, 85 and 70 is repeated until the count of the forward counter is 0.

When the pulses corresponding to the number set in the forward counter are generated, the count of the forward counter becomes 0 in the clock count routine. Therefore, steps 70, 71, 72 and 73 are performed, and the clutch 3-4 is turned off to terminate the scanning operation. In step 74, the "forward F" is set to 0. The copy sheets counter is decremented in step 75 and the count of the copy sheets counter is displayed in step 76. In step 77, it is discriminated whether the count of the copy sheets counter is 0. If YES in step 77, it means that the current copy is the last one. Therefore, the "continuous F" is set to 0 in step 78. In NO in step 77, the "continuous F" is set to 1 in step 79. In step 80, the backward clutch 3-3 is turned on. A loop of steps 85, 70, 71 and 85 is repeated until the original base 23 returns to the home position, that is, until YES in step 85. When the original base returns to the home position, the flow advances fromm step 85 to step 86, wherein it is discriminated whether the "continuous F" is 1. If the "continuous F" is 0 in step 86, the flow advances to step 88 wherein the main motor, the high voltage and so on are turned off to stop the operation of the apparatus and the flow returns to the standby routine. If the "continuous F" is 1, the flow advances to step 87 wherein the "continuous F" is set to 0, and the flow jumps to step 40 to allow the next copying operation. The standby routine may be included in step 78. In this manner copying operation may be continued with the changed magnification.

The scanning stroke of the original base 23 is performed and inverted in correspondence with the number of pulses which, in turn, corresponds to $n_1$ to $n_9$ set by the forward counter. To the minimum scanning width of a cassette of large size correspond, $n_2$, $n_4$, $n_6$ and $n_8$; and to the minimum scanning width of a cassette of small size correspond $n_3$, $n_5$ $n_7$ and $n_9$. Therefore, the inverting point of the movement of the original base 23 varies in accordance with the selected magnification and the cassette size, resulting in efficient scanning operation. The size of the transfer paper sheet may be directly detected instead of detecting the size of the cassette.

In the case of enlargement copying, scanning is performed for a scanning stroke corresponding to a cassette of large size and for a time duration corresponding to $n_1$ pulses irrespective of the cassette size. In other magnifications, scanning is performed for the minimum stroke in accordance with the size of the cassette.

In the case of enlargement copying, the scanning area for forming an image on a transfer paper sheet of small size is smaller than this small size. Therefore, the scanning stroke for the cassette of small size becomes very short. However, in this case, since part of the glass plate 22 is radiated with light, continuous multicopying for a long period of time results in a temperature rise at this part of the glass plate 22, causing various problems. However, this problem may be solved according to the present invention.

Figure 7:
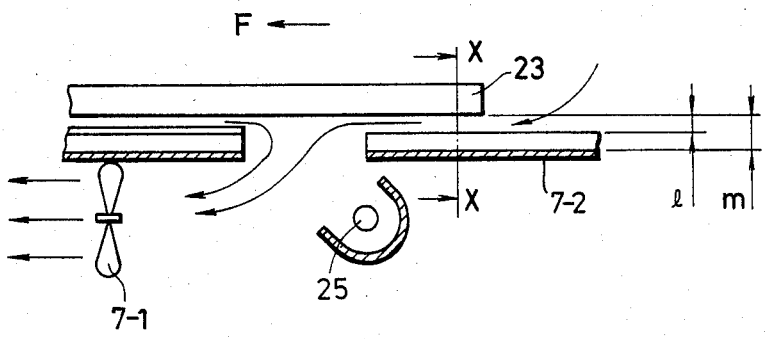
FIG. 7 is a partial enlarged view of the original base.

As shown in FIG. 7 the apparatus of the present invention, prevents degradation of the cooling effect. Ordinarily, when the stroke is short, the forward movement F of the original base 23 is inverted at a position at the righthand side of FIG. 7. In this case, the air path between the original base 23 and the apparatus main body 7-2 becomes longer and the air flow becomes weaker. When this occurs, heat generated by the original exposure lamp 25 cannot effectively be expelled outside the apparatus by a fan 7-1. Then, the temperature of the glass plate 22 is raised which may cause safety problems for the operator. However, according to the present invention, scanning is performed for a stroke corresponding to a cassette of large size—, even if the cassette is of small size to thus moving the original base 23 further toward the left and thereby preventing a temperature rise in the glass plate 22.

What is claim is:

1. A variable magnification image reproducing apparatus comprising:

operable means for reproducing an original image, said operable means including a rotatable medium and means for changing a magnification of the original image to form an image having a changed magnification on said rotatable medium;

manual input means for selecting the magnification; and means for allowing entry of a signal for changing the magnification from said manual input means and for allowing an operation for changing the magnification by said magnification changing means in response to the signal from said manual input means while said rotatble medium is rotating and for allowing the entry of the signal for changing the magnification to another changed magnification while said magnification changing means is in operation.

2. A variable magnification image reproducing apparatus comprising:

operable means for reproducing an original image, said operable means including a rotatable medium and means for changing a magnification of the original image to form an image having a changed magnification on said rotatable medium;

manual input means for selecting the magnification;

means for rotating said rotatable medium before a first copy reproduction; and means for allowing entry of a signal for changing the magnification from said manual input means while said rotatable medium is rotated by said rotating means.

3. A variable magnification image reproducing apparatus comprising:

operable means for reproducing an original image, said operable means including a rotatable medium and means for changing a magnification of the original image to form an image having a changed magnification on said rotatable medium;

manual input means for selecting the magnification;

means for rotating said rotatable medium before a first copy reproduction; and means for allowing an operation of said magnification changing means for changing the magnification while said rotatable medium is rotated by said rotating means.

4. A variable magnification image reproducing apparatus comprising:

operable means for reproducing an original image, said operable means including a member for scanning an original image and means for changing a magnification of the original image;

manual input means for selecting the magnification; and means for allowing entry of a signal for changing the magnification from said manual input means and for allowing an operation for changing the magnification by said magnification changing means while said scanning member is in operation.

5. A variable magnification image reproducing apparatus comprising:

operable means for reproducing an original image, said operable means including a member for scanning an original image and means for changing a magnification;

manual input means for selecting the magnification;

means for setting said scanning member at a position for starting scanning movement before a first image scanning; and means for allowing entry of a signal for changing the magnification from said manual input means while said setting means moves said scanning member.

6. A variable magnification image reproducing apparatus comprising:

operable means for reproducing an original image, said operable means including a member for scanning the original image and means for changing a magnification;

manual input means for selecting the magnification;

means for setting said scanning member at a position for starting scanning movement before a first image scanning; and means for allowing an operation for changing the magnification by said magnification changing means while said setting means moves said scanning member.

7. A variable magnification image reproducing means comprising:

operable means for reproducing an original image, said operable means including means for changing a magnification of the original image;

manual input means for selecting the magnification;

start input means for instructing reproduction start; and means for allowing the magnification to be changed by said magnification changing means within a predetermined period of time after instructing reproduction start by said start input means.

8. A variable magnification image reproducing apparatus comprising:

operable means for reproducing an original image on a medium, said operable means including a platen for placing the original thereon, means for moving said platen for scanning the original image and means for enlarging the original image;

manual input means for selecting between enlargement and equal magnification; and control means, responsive to said manual input means for controlling said moving means so as to change a scanning stroke of said platen in accordance with a size signal when equal magnification is selected by said manual input means, and so as to keep the scanning stroke of said platen constant at a substantially maximum stroke irrespective of the size signal when enlargement is selected by said manual input means.

9. A variable magnification image reproducing apparatus comprising:

operable means for reproducing an original image, said operable means including a rotatable medium and means for changing a magnification of the original image to form an image having a changed magnification on said rotatable medium;

manual input means for selecting the magnification; and means for alowing entry of a signal for changing the magnification from said manual input means and allowing an operation for changing the magnification by said magnification changing means in response to the signal from said manual input means while said rotatable medium is rotating, and for allowing the entry of the signal from said manual input means to change the magnification to another changed magnification while said magnification changing means is in operation.

10. A variable magnification image reproducing apparatus comprising:

operable means for reproducing an original image, said operable means including means for changing a magnification of the original image;

manual input means for selecting the magnification;

start input means for instructing reproduction start; and means for allowing the magnification to be changed by said magnification changing means within a predetermined period of time after instructing reproduction start by said start input means.

* * * * *

UNITED STATES PATENT AND TRADEMARK OFFICE

CERTIFICATE OF CORRECTION

PATENT NO. : 4,512,655

DATED : April 23, 1985

INVENTOR(S) : MASATO ISHIDA, ET AL.

It is certified that error appears in the above-identified patent and that said Letters Patent is hereby corrected as shown below:

Column 2, line 63, "infromation" should read --information--.

Column 4, line 21, "dificiency" should read --deficiency--.

Column 8, line 17, "prerotation" should read --pre-rotation--.

Column 11, line 3, "fromm" should read --from--;
line 19, "large" should read --small--;
line 44, after "7" insert --,--;
line 45, after "invention" delete ",";
line 57, after "size" delete -- – --;
line 58, "to" should read --,--;

Signed and Sealed this

*Eleventh* Day of *March 1986*

[SEAL]

*Attest:*

DONALD J. QUIGG

*Attesting Officer*

*Commissioner of Patents and Trademarks*